US007104344B2

(12) United States Patent
Kriesels et al.

(10) Patent No.: US 7,104,344 B2
(45) Date of Patent: Sep. 12, 2006

(54) PERCUSSION DRILLING HEAD

(75) Inventors: Petrus Cornelis Kriesels, Ta Assen (NL); Djurre Hans Zijsling, Gd Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/490,173

(22) PCT Filed: Sep. 19, 2002

(86) PCT No.: PCT/EP02/10530

§ 371 (c)(1),
(2), (4) Date: Aug. 2, 2004

(87) PCT Pub. No.: WO03/025327

PCT Pub. Date: May 27, 2003

(65) Prior Publication Data

US 2004/0256155 A1 Dec. 23, 2004

(30) Foreign Application Priority Data

Sep. 20, 2001 (EP) ..... 01308019

(51) Int. Cl.
*E21B 10/36* (2006.01)
*E21B 10/42* (2006.01)

(52) U.S. Cl. ..... 175/57; 175/420.2; 175/296; 175/415

(58) Field of Classification Search ..... 175/57, 175/415, 420.2, 296
See application file for complete search history.

(56) References Cited

U.S. PATENT DOCUMENTS 1,748,341 A * 2/1930 Grant et al. ..... 175/319
1,891,416 A * 12/1932 Harris ..... 175/96
2,859,941 A * 11/1958 Carroll et al. ..... 175/106
2,868,511 A * 1/1959 Barrett ..... 175/92
2,873,093 A * 2/1959 Hildebrandt et al. ..... 175/92
3,142,347 A * 7/1964 Barnes ..... 175/349
3,297,099 A * 1/1967 Adams et al. ..... 175/96
3,387,673 A 6/1968 Thompson ..... 175/96
3,807,512 A * 4/1974 Pogonowski et al. ..... 175/106

(Continued)

FOREIGN PATENT DOCUMENTS

DE 1097920 1/1961

(Continued)

OTHER PUBLICATIONS

International Search Reported dated Nov. 13, 2002.

(Continued)

*Primary Examiner*—William Neuder
*Assistant Examiner*—Nicole A Coy

(57) ABSTRACT

Device and method for drilling into geological formations. The device comprises:

a rotatable body;

drilling cutters arranged on an axial end surface of the rotatable body;

a percussion part, which is parallel to the rotating axis reciprocatable arranged on said body; and percussion cutters arranged on an axial end surface of the percussion part.

The method comprises the steps of:

bringing a percussion part with a percussive movement in contact with the formation in order to crack at least a part of the formation, and scraping the cracked parts of the formation with a drilling part.

18 Claims, 4 Drawing Sheets

U.S. PATENT DOCUMENTS

| | | | | |
|---|---|---|---|---|
| 4,228,862 | A | 10/1980 | Causse | 175/242 |
| 4,262,758 | A * | 4/1981 | Evans | 175/73 |
| 4,352,400 | A | 10/1982 | Grappendorf et al. | 175/330 |
| 4,558,753 | A | 12/1985 | Barr | 175/329 |
| 4,940,097 | A * | 7/1990 | Martini | 175/296 |
| 5,139,099 | A * | 8/1992 | Hayashi et al. | 175/292 |
| 5,595,252 | A | 1/1997 | O'Hanlon | 175/57 |
| 5,794,728 | A | 8/1998 | Palmberg | 175/400 |
| 5,880,382 | A | 3/1999 | Fang et al. | 75/236 |
| 6,253,864 | B1 | 7/2001 | Hall | 175/415 |
| 6,374,931 | B1 * | 4/2002 | Nieves | 175/420.1 |
| 2002/0153173 | A1 * | 10/2002 | Wisser et al. | 175/388 |
| 2003/0024739 | A1 * | 2/2003 | Runquist et al. | 175/61 |
| 2003/0230434 | A1 * | 12/2003 | Binon et al. | 175/415 |
| 2005/0045380 | A1 * | 3/2005 | Eddison | 175/57 |

FOREIGN PATENT DOCUMENTS

| | | |
|---|---|---|
| DE | 3941609 | 10/1991 |
| EP | 0358786 | 3/1990 |
| EP | 0874126 | 10/1998 |
| FR | 2581697 | 11/1986 |
| WO | 02099242 | 12/2002 |

OTHER PUBLICATIONS

"Development and Testing of a Down-Hole Mud Actuated Hammer", Phase II final report, NOVATEK, prepared by David S. Pixton, May 1999.

Drilling RD&D Program, NADET Institute, at the Morgantown Energy Technology Center of the US Department of Energy, 5 pgs.

"A New-Generation Mud-Hammer Drilling Tool Annual Report", D. Pixton, et al, NOVATEK, Inc.

"Emerging Technologies for the Natural Gas Industry in the Spotlight", U.S. Department of Energy's Natural Gas Conference Proceedings, Houston, Texas Mar. 24-27, 1997.

Recent Advances in Polycrystalline Diamond (PCD) Technology, M.V. Sneddon, et al., Society of Petroleum Engineers SPE 17007, 1987.

* cited by examiner

PERCUSSION DRILLING HEAD

The present application claims priority on European Patent Application 01308019.7 filed on 20 Sep. 2001.

FIELD OF INVENTION

The invention relates to a device for drilling into geological formations, which device comprises:

a rotatable body;

drilling cutters arranged on an axial end surface of the rotatable body.

BACKGROUND OF THE INVENTION

Such devices are generally known. The drilling cutters form a rotating movement with which they scrape parts of the bottom of the hole to be formed. These cuttings are then removed by for example the drilling fluid.

When however a hole has to be drilled into a geological formation of a relatively hard material, this scraping action is very slow and has a low yield.

To alleviate this disadvantage drilling devices are known which use the same principle as a hammer drill. In such a device a bit part is rotated and a hammer part is hammered against this bit part. The vibrations caused by the hammering of the hammer part cause cracks into the material in which the hole is drilled. The rotating bit then scrapes off the cracked parts of the material. A disadvantage of such a device is that the cutters have to endure high forces because of the hammering resulting in an excessive wear of the drill cutters. Another disadvantage is that part of the hammering energy is absorbed in the contact surface between drill bit and hammer part.

Yet another disadvantage is that the cuttings are not adequately removed as no scraping action is performed during lift-off of the bit part.

A further disadvantage is that when sharp cutters are used, which will penetrate the formation, the cutters will hinder rotation of the drilling device.

SUMMARY OF THE INVENTION

The invention provides a drilling device comprising:

a percussion part, which is parallel to the rotating axis reciprocatably arranged relative to said body;

percussion cutters arranged on an axial end surface of the percussion part.

Because the rotational drilling action is separated from the percussion action, both the drilling cutters and the percussion cutters can be optimized for their specific task. The percussion part, which is reciprocatably arranged relative to the rotatable body comes in direct contact with the material to be drilled, such that the full energy of the stroke of the percussion part is absorbed by the material to be drilled. The drilling cutters only perform a rotating movement, such that they scrape off the material, which has been cracked by the percussion part.

The separation of the percussion action and the drilling action ensures also that the drilling part is in constant contact with the bottom of the hole and that the percussion part will make full strokes. The percussion part could be reciprocatably driven by driving means. These driving means could be electric or hydraulic. An advantage of hydraulic driving means is that the drilling fluids could be used to drive the percussion part. Furthermore, since the allowable stroke of the percussion part is significantly larger than for conventional percussion drilling devices, it is particularly attractive to apply hydraulic driving means.

In a preferred embodiment the drilling cutters comprise PDC. (polycrystalline diamond compact).

It is also possible that the drilling cutters are provided at at least one roller cone. Correspondingly, the percussion cutters could also be provided at at least one roller cone.

In a preferred embodiment of a device according to the invention the percussion cutters are at least partly sphere-shaped. A sphere-shape is an optimal shape in view of strength.

In another preferred embodiment the percussion cutters have a sharp edge to penetrate the formation. Sharp cutters are more effective in penetrating and cracking the formation than sphere shaped cutters. As these percussion cutters reciprocate relative to the drilling cutters, which are in constant contact with the bottom of the hole, the percussion cutters will be in contact with the bottom for a short time and will therefore hinder minimally the rotation of the drilling device.

In another embodiment of the device according to the invention nozzles are arranged into the axial end surface of the percussion part and/or the axial end surface of the body. These nozzles provide jets of drilling fluid. These jets are used for cooling, lubrication and for discharging the scrapings.

In an other preferred embodiment of the device according to the invention an end part of the percussion part has a fan-shaped cross section and an end part of the rotatable body has a complementary cross section, such that the end part of the percussion part is axially guided by the end part of the rotatable body. Seen in rotation direction, the drilling cutters are preceded by a percussion part. These percussion parts crack the material to be drilled and subsequently the drilling cutters scrape of the cracked cutters.

The invention also relates to a method for drilling into geological formations, which method comprises the steps of:

bringing a percussion part with a percussive movement in contact with the formation in order to crack at least a part of the formation, and scraping the cracked parts of the formation with a drilling part.

These and other advantages and features of the invention will be elucidated in the following description with the accompanying drawings.

DETAILED DESCRIPTION OF THE PREFERRED EMBODIMENT

Figure 1:
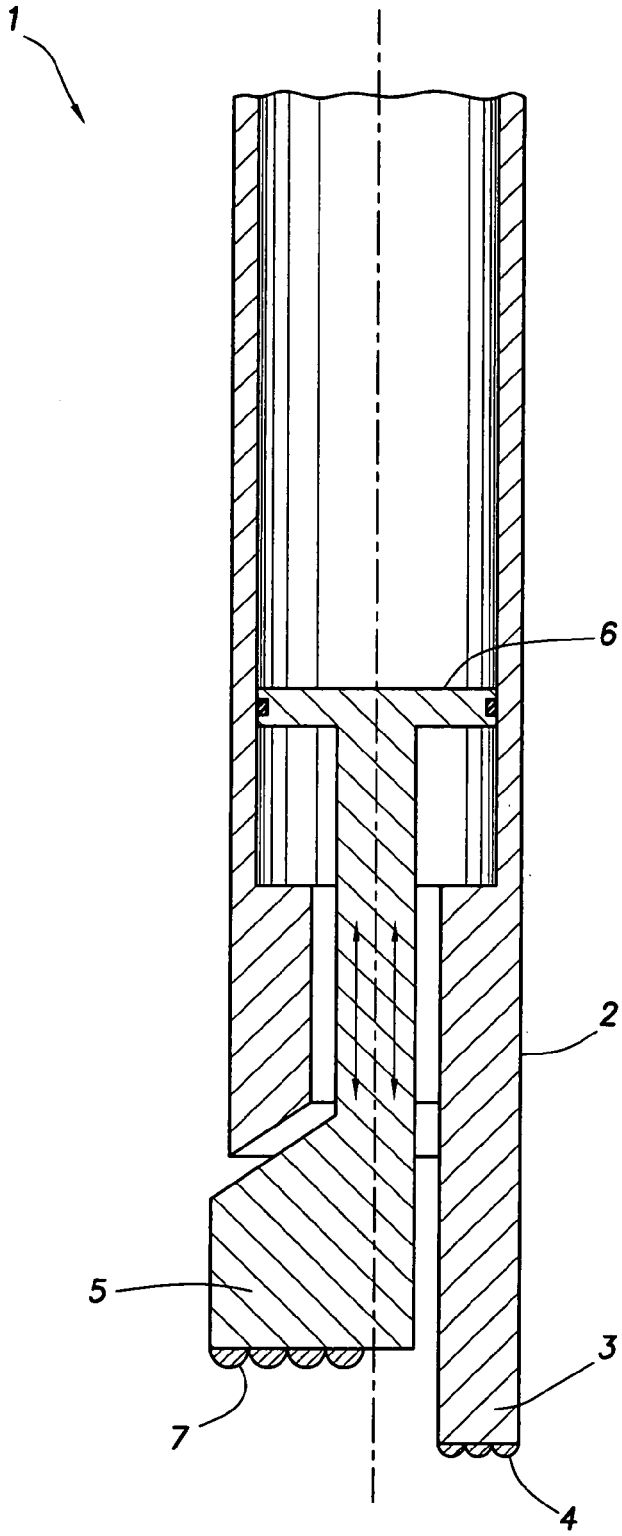
FIG. 1 shows a cross sectional view of a device according to the invention.

FIG. 1 shows a schematical cross sectional view of a drilling device 1 according to the invention. This drilling device 1 comprises a rotational body 2. On the axial end surface 3 of the rotational body 2, drilling cutters 4 are arranged.

The device further comprises a percussion part 5, which is reciprocatable arranged on the rotational body 2. This percussion part is driven by a hydraulic cylinder 6. Percussion cutters 7 are arranged at the axial end surface of the percussion part.

Figure 2:
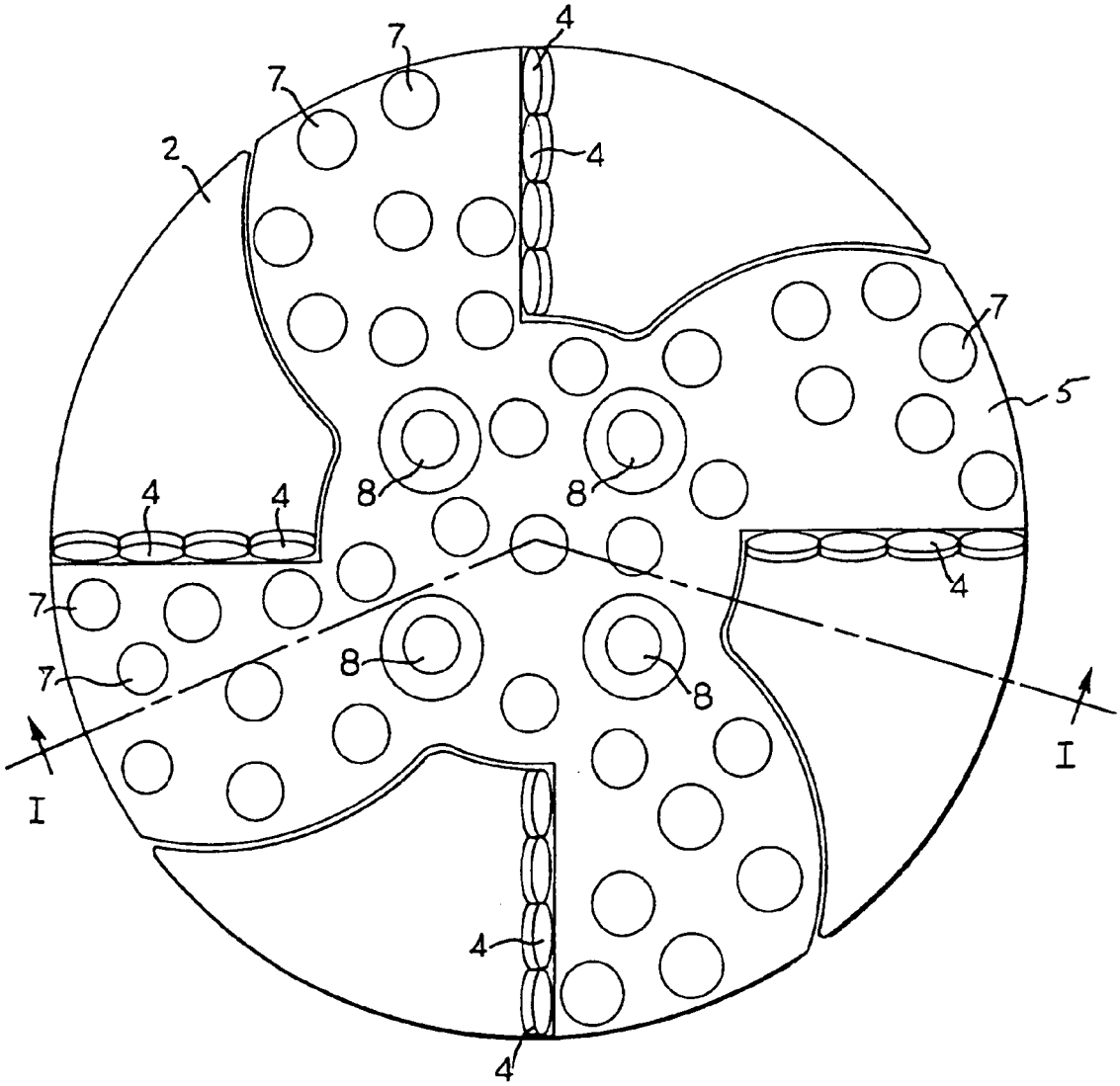
FIG. 2 shows a bottom view of the device according to FIG. 1.

In FIG. 2 a bottom view is shown. In this figure the section line I—I of FIG. 1 is shown. The percussion part 5 has a fan-shaped cross section in which nozzles 8 are arranged. The rotational body 2 has a shape, which is complementary to the fan-shape of the percussion part. The rotational body 2 and the percussion part 5 constitute together a circular cross section.

Figure 3:
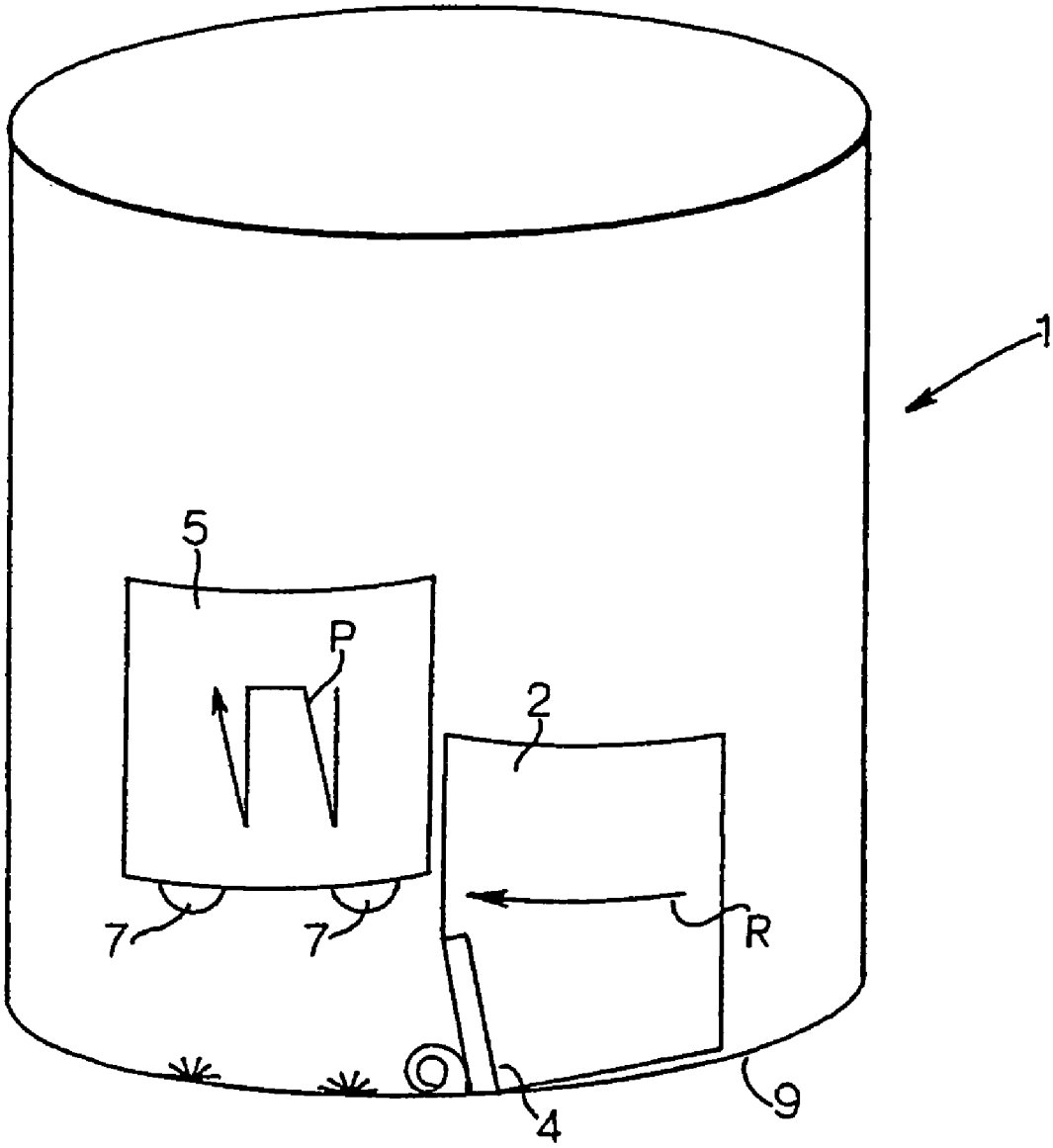
FIG. 3 shows a schematical side view of a device according to FIG. 1.

FIG. 3 shows schematically the operation of a drilling device 1 according to the invention. The rotational body 2 makes a rotational movement R. The drilling cutters 4 stay in constant contact with the bottom 9 of the hole to be drilled. The percussion part 5 moves up and down according to the movement P. Because the percussion part 5 is separated from the rotational body 2, the stroke of the reciprocating movement can be large, such that the percussion cutters hit the bottom 9 of the hole with a considerable speed and thus energy as a result of which the material of the bottom 9 cracks more easily and can consequently easier be scraped of by the drilling cutters 4.

An advantage of a device according to the invention is that stick-slip is diminished or even eliminated as a result of the percussion movement of the percussion part. Also because of the short contact time of the percussion part 5, this stick-slip is avoided.

The vibrations caused by the percussion part could be used as an acoustic source for seismic measurements. These seismic measurements are used to determine what kind of formation is present under the bottom of the hole.

Figure 4:
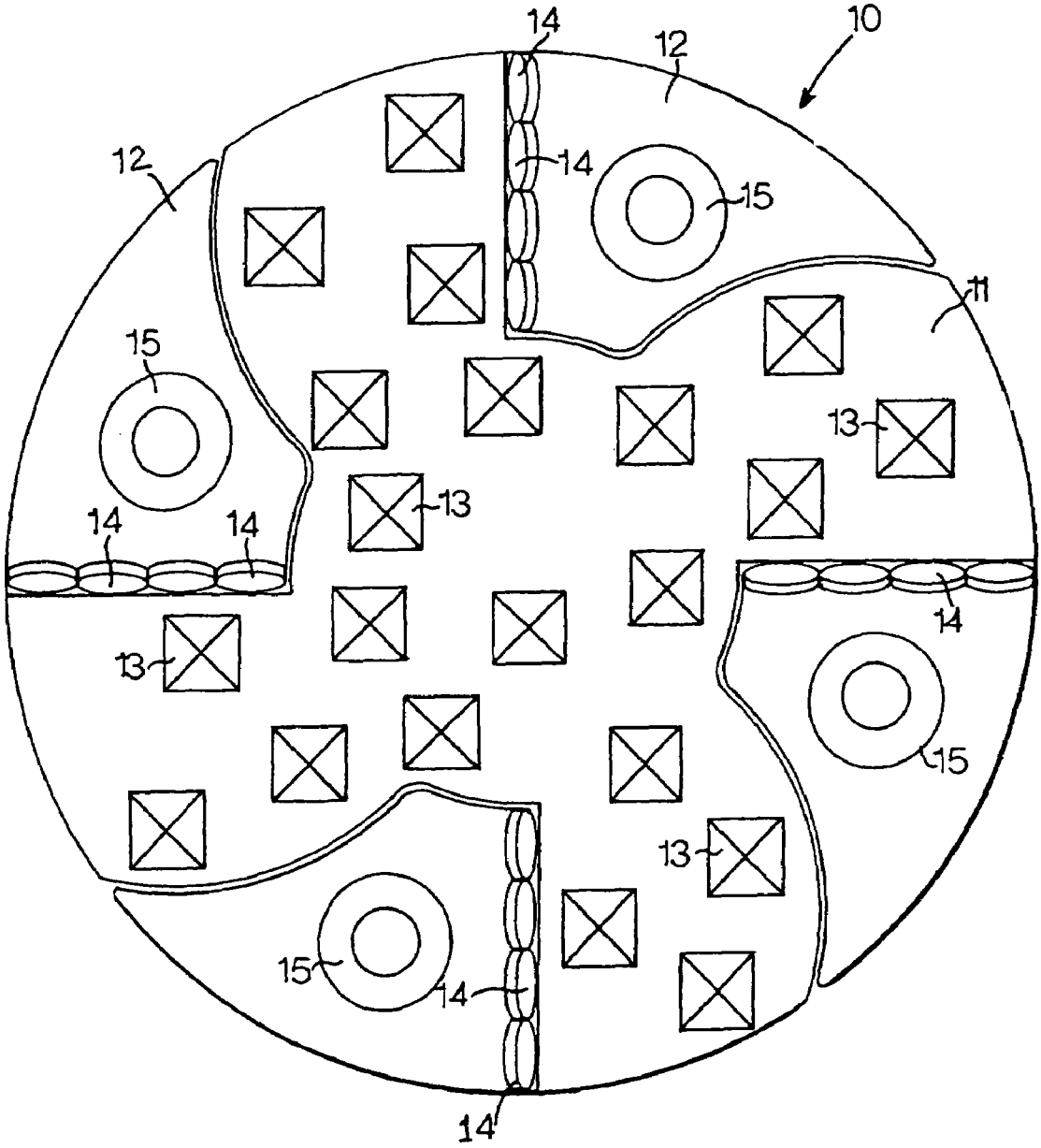
FIG. 4 shows a bottom view of a second embodiment of the device according to the invention.

In FIG. 4 a second embodiment of a device according to the invention is shown. This device 10 has again a percussion part 11 and a drilling part 12. The percussion part 11 is provided with a number of percussion cutters 13, which are pyramid shaped. This pyramid shape provides a good cracking action for cracking the formation at the bottom of the hole.

The drilling part 12 is provided with drilling cutters 14 and nozzles 15 for supplying drilling fluids.

The percussion part 11 performs a reciprocatable movement in order to hammer onto the formation. This reciprocatable movement could be combined with a rotational movement, such that the peripheral part of the percussion part 11 has a helical path of movement. Preferably, this rotation has the same direction as the drilling rotation.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A device for drilling into a geological formation comprising:

a body rotatable about a rotating axis;

drilling cutters arranged on an axial end surface of the rotatable body;

a percussion part, which is parallel to the rotating axis reciprocatably arranged relative to said body for cracking a part of the geological formation to be drilled; and percussion cutters arranged on an axial end surface of the percussion part;

wherein the drilling cutters are arranged for scraping the cracked part of the geological formation and the axial end surface of the percussion part and the axial end surface of the rotating body overlap each other in radial direction with respect to the rotating axis.

2. The device of claim 1, further comprising driving means for reciprocatably driving of the percussion part.

3. The device of claim 2, wherein the driving means are hydraulic driving means.

4. The device of claim 1, wherein the drilling cutters comprise polycrystalline diamond.

5. The device of claim 1, wherein the percussion cutters are at least partly sphere shaped.

6. The device of claim 1, wherein the percussion cutters comprise a sharp cufling edge.

7. The device of claim 1, wherein nozzles are arranged into at least one of the group consisting of the axial end surface of the percussion part and the axial end surface of the body.

8. The device of claim 1, wherein an end part of the percussion part has a fan shaped cross-section and that an end part of the rotatable body has a complementary cross-section, such that the end part of the percussion part is axially guided by the end part of the rotatable body.

9. The device of claim 1, wherein a peripheral part of the percussion part has a helical path of movement.

10. A method for drilling into a geological formation, comprising:

providing a device comprising:

a body rotatable about a rotating axis;

drilling cutters arranged on an axial end surface of the rotatable body;

a percussion part, which is parallel to the rotating axis reciprocatably arranged relative to said body for cracking a part of the geological formation to be drilled; and percussion cutters arranged on an axial end surface of the percussion part, wherein the drilling cutters are arranged for scraping the cracked part of the geological formation and the axial end surface of the percussion part and the axial end surface of the rotating body overlap each other in radial direction with respect to the rotating axis;

the method further comprising:

bringing the percussion part of the device with a percussive movement in contact with the formation in order to crack at least a part of the geological formation; and scraping the cracked parts of the geological formation with a separate drilling part comprising the drilling cutters.

11. A device for drilling into a geological formation comprising:

a body rotatable about a rotating axis;

drilling cutters arranged on an axial end surface of the rotatable body;

a percussion part, which is parallel to the rotating axis reciprocatably arranged relative to said body for cracking a part of the geological formation to be drilled, wherein an end part of the percussion part has a fan shaped cross-section and that an end part of the rotatable body has a complementary cross-section, such that the end part of the percussion part is axially guided by the end part of the rotatable body; and percussion cutters arranged on an axial end surface of the percussion part;

wherein the drilling cutters are arranged for scraping the cracked part of the geological formation.

12. The device of claim 11, wherein a peripheral part of the percussion part has a helical path of movement.

13. The device of claim 11, further comprising driving means for reciprocatably driving of the percussion part.

14. The device of claim 13, wherein the driving means are hydraulic driving means.

15. The device of claim 11, wherein the drilling cutters comprise polycrystalline diamond.

16. The device of claim 11, wherein the percussion cutters are at least partly sphere shaped.

17. The device of claim 11, wherein the percussion cutters comprise a sharp cutting edge.

18. The device of claim 11, wherein nozzles are arranged into at least one of the group consisting of the axial end surface of the percussion part and the axial end surface of the body.

* * * * *